US010395572B2

(12) United States Patent
Jee

(10) Patent No.: US 10,395,572 B2
(45) Date of Patent: Aug. 27, 2019

(54) DISPLAY DEVICE AND METHOD OF TESTING A DISPLAY DEVICE

(71) Applicant: Samsung Display Co., Ltd., Yongin-si, Gyeonggi-do (KR)

(72) Inventor: Ahn-Ho Jee, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 38 days.

(21) Appl. No.: 15/354,882

(22) Filed: Nov. 17, 2016

(65) Prior Publication Data

US 2017/0162094 A1 Jun. 8, 2017

(30) Foreign Application Priority Data

Dec. 7, 2015 (KR) ..... 10-2015-0173167

(51) Int. Cl.

| | |
|---|---|
| ***G09G 3/00*** | (2006.01) |
| ***G09G 3/3266*** | (2016.01) |
| ***G09G 3/3291*** | (2016.01) |
| ***G09G 3/20*** | (2006.01) |
| ***G09G 3/3275*** | (2016.01) |

(52) U.S. Cl.

CPC ..... *G09G 3/006* (2013.01); *G09G 3/20* (2013.01); *G09G 3/3266* (2013.01); *G09G 3/3275* (2013.01); *G09G 3/3291* (2013.01); *G09G 2310/0267* (2013.01); *G09G 2320/0276* (2013.01); *G09G 2320/043* (2013.01); *G09G 2320/0673* (2013.01); *G09G 2320/0693* (2013.01); *G09G 2360/16* (2013.01)

(58) Field of Classification Search

CPC ..... G09G 3/006; G09G 3/20; G09G 3/3266; G09G 3/3275; G09G 3/3291; G09G 2310/0267; G09G 2320/0276; G09G 2320/043; G09G 2320/0673; G09G 2320/0693; G09G 2360/16

See application file for complete search history.

(56) References Cited

U.S. PATENT DOCUMENTS

| | | | | |
|---|---|---|---|---|
| 6,628,825 | B1 * | 9/2003 | Yamazoe | H04N 1/6077 358/518 |
| 2007/0008598 | A1 * | 1/2007 | Tsukagoshi | G11B 7/00736 359/9 |
| 2009/0109490 | A1 * | 4/2009 | Lau | H04N 1/4052 358/3.06 |
| 2010/0309374 | A1 * | 12/2010 | Lee | G09G 3/20 348/500 |
| 2010/0310094 | A1 * | 12/2010 | Lee | G09G 3/3233 381/107 |

(Continued)

FOREIGN PATENT DOCUMENTS

KR 10-2011-0024529 A 3/2011

*Primary Examiner* — Dmitriy Bolotin
(74) *Attorney, Agent, or Firm* — Lewis Roca Rothgerber Christie LLP

(57) ABSTRACT

A display device includes a display panel including a display panel including pixels, a timing controller configured to calculate an on-pixel ratio of input image data provided from an external component, and a data driver configured to select a first gamma correction value from among a plurality of gamma correction values based on the on-pixel ratio, and configured to generate a data signal based on the input image data and the first gamma correction value.

9 Claims, 7 Drawing Sheets

(56) References Cited

U.S. PATENT DOCUMENTS

| | | | | |
|---|---|---|---|---|
| 2013/0342585 | A1* | 12/2013 | Chun | G09G 3/3208 345/690 |
| 2015/0091950 | A1* | 4/2015 | Park | G09G 3/3291 345/690 |
| 2016/0133223 | A1* | 5/2016 | Kim | G09G 3/20 345/211 |
| 2016/0189619 | A1* | 6/2016 | Park | G09G 3/3258 345/690 |
| 2016/0217745 | A1* | 7/2016 | Park | G09G 3/3283 |
| 2017/0039997 | A1* | 2/2017 | An | G09G 5/10 |
| 2017/0092189 | A1* | 3/2017 | Hwang | G09G 3/2003 |
| 2017/0110059 | A1* | 4/2017 | Sung | G09G 3/3275 |

* cited by examiner

DISPLAY DEVICE AND METHOD OF TESTING A DISPLAY DEVICE

CROSS-REFERENCE TO RELATED APPLICATION

This application claims priority to, and the benefit of, Korean Patent Application No. 10-2015-0173167, filed on Dec. 7, 2015 in the Korean Intellectual Property Office (KIPO), the content of which is incorporated herein in its entirety by reference.

BACKGROUND

1. Field

Embodiments relate to a display device that compensates a luminance error between a target luminance, which corresponds to a reference gamma curve, and a real luminance, and also relate to a method of testing a display device to determine a correction value for the luminance error.

2. Description of the Related Art

A display device displays images using a gamma curve that represents a correlation between a grayscale value and a display luminance. The display device has a luminance error between a target luminance corresponding to the gamma curve, and a real display luminance corresponding to the grayscale value. The display device has a gamma correction value to compensate the luminance error, where the gamma correction value is determined during a module testing process of the display device.

However, the luminance error may occur due to change of the image, despite the display device displaying an image based on the gamma correction value.

SUMMARY

Some embodiments provide a display device that is configured to reduce a luminance error.

Some embodiments provide a method of testing a display device to determine a gamma correction value for compensating a luminance error.

According to embodiments, a display device may include a display panel including a display panel including pixels, a timing controller configured to calculate an on-pixel ratio of input image data provided from an external component, and a data driver configured to select a first gamma correction value from among a plurality of gamma correction values based on the on-pixel ratio, and configured to generate a data signal based on the input image data and the first gamma correction value.

The on-pixel ratio may represent a ratio of a number of the pixels that are turned on according to the input image data to a total number of the pixels.

The input image data may include frames, and the timing controller may be configured to calculate the on-pixel ratio for each of the frames.

The gamma correction values may respectively correspond to different on-pixel ratios.

The first gamma correction value may be based on a test image that has the on-pixel ratio, and the first gamma correction value may include a correction value to compensate a difference between a target luminance of the display panel that corresponds to a gamma curve and a real luminance of the display panel that corresponds to the input image data.

The data driver may be configured to select a second gamma correction value, which corresponds to a second on-pixel ratio that is adjacent the on-pixel ratio, from among the gamma correction values, and the data driver may be configured to determine the first gamma correction value with the second gamma correction value.

The data driver may be configured to select a second gamma correction value, which corresponds to a second on-pixel ratio, from among the gamma correction values, and may be configured to select a third gamma correction value, which corresponds to a third on-pixel ratio, from among the gamma correction values, the data driver may be configured to calculate the first gamma correction value based on the second gamma correction value and the third gamma correction value, and the second gamma correction value and the third gamma correction value may correspond to on-pixel ratios that are closest to the on-pixel ratio.

The data driver may be configured to calculate the first gamma correction value by interpolating the second gamma correction value and the third gamma correction value.

Each of the pixels may include a first sub pixel, a second sub pixel, and a third sub pixel, and the timing controller may be configured to calculate a first sub on-pixel ratio for the first sub pixel, a second sub on-pixel ratio for the second sub pixel, and a third sub on-pixel ratio for the third sub pixel, respectively.

The timing controller may be configured to select a first sub gamma correction value from among the gamma correction values based on the first sub on-pixel ratio, may be configured to select a second sub gamma correction value from among the gamma correction values based on the second sub on-pixel ratio, and may be configured to select a third sub gamma correction value from among the gamma correction values based on the third sub on-pixel ratio.

According to embodiments, a method of testing the display device including a display panel may include selecting a first test image that has a first on-pixel ratio from among a plurality of test images that have different on-pixel ratios, and performing a first multi-time program for the display panel based on the first test image for determining a first gamma correction value to compensate a difference between a target luminance of the display panel, which corresponds to a gamma curve, and a real luminance of the display panel, which corresponds to the first test image.

The first on-pixel ratio may represent a ratio of a number of pixels that are turned on according to input image data to a total number of pixels in the display panel.

Performing the first multi-time program may include calculating the target luminance using the gamma curve, measuring the real luminance corresponding to the first test image based on the first gamma correction value, and calculating a luminance difference between the target luminance and the real luminance.

Performing the first multi-time program may further include determining whether the luminance difference is within an acceptable tolerance, and storing the first gamma correction value when the luminance difference is within the acceptable tolerances.

Performing the first multi-time program may further include adjusting the first gamma correction value based on the luminance difference when the luminance difference is beyond the acceptable tolerance, re-measuring the real luminance according to the first test image based on a compensated first gamma correction value, re-calculating the luminance difference between the target luminance and the re-measured real luminance, and storing the compensated first gamma correction value when the re-calculated luminance difference is within the acceptable tolerances.

The method may further include selecting a second test image that has a second on-pixel ratio from among the plurality of the test images, and performing a second multi-time program for the display panel based on the second test image.

The second on-pixel ratio may be determined based on acceptable tolerances of the gamma curve of the display panel.

The method may further include determining a second gamma correction value corresponding to a second on-pixel ratio based on the first gamma correction value.

Determining the second gamma correction value may include calculating the second gamma correction value using a linear equation that represents a correlation between the first gamma correction value and the second gamma correction value.

The display panel may include first through third sub pixels, and performing the first multi-time program may include performing first through third sub multi-time programs for each of the first through third sub pixels, respectively.

Therefore, a display device according to embodiments may reduce a luminance error (or, may reduce a luminance difference between a target luminance and a real luminance) by including gamma correction values that are determined (or, set) for every on-pixel ratio, by selecting a certain gamma correction value among the gamma correction values based on an on-pixel ratio of input image data, and by generating a data signal based on the certain gamma correction value (or, based on a selected gamma correction value).

In addition, a method of testing a display device according to embodiments may determine (or, set) gamma correction values using test images (or, test patterns) that have difference on-pixel ratios.

BRIEF DESCRIPTION OF THE DRAWINGS

Illustrative, non-limiting embodiments will be more clearly understood from the following detailed description taken in conjunction with the accompanying drawings.

DETAILED DESCRIPTION

Figure 1:
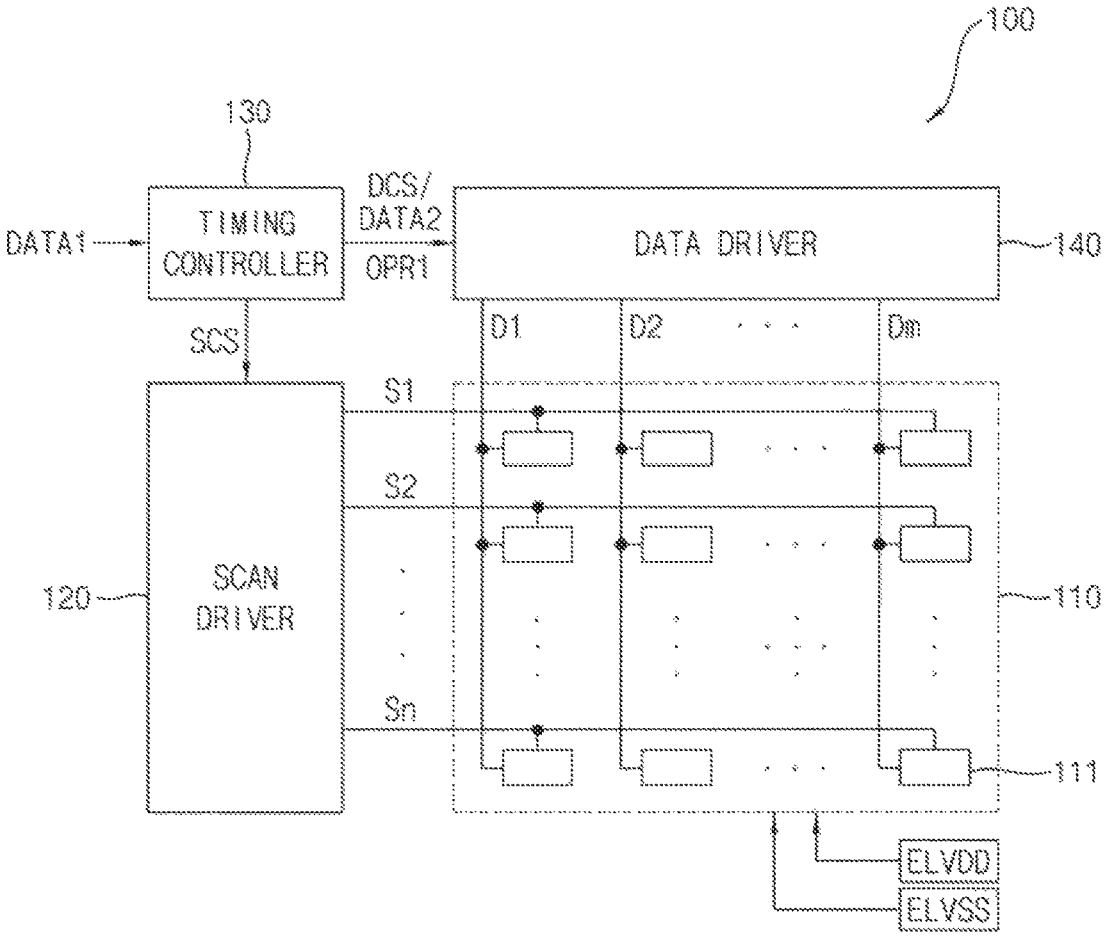
FIG. 1 is a block diagram illustrating a display device according to embodiments.

Features of the inventive concept and methods of accomplishing the same may be understood more readily by reference to the following detailed description of embodiments and the accompanying drawings. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or"

includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Hereinafter, the present inventive concept will be explained in detail with reference to the accompanying drawings.

FIG. 1 is a block diagram illustrating a display device according to embodiments.

Referring to FIG. 1, a display device 100 may include a display panel 110, a scan driver 120, a timing controller 130, and a data driver 140.

The display device 100 may display (or, output) an image based on input image data (e.g., based on first input image data DATA1) provided from an external component. For example, the display device 100 may be an organic light emitting display device.

The display panel 110 may include scan lines S1 through Sn, data lines D1 through Dm, and a pixel (or, pixels) 111, where each of n and m is a positive integer. The pixels 111 may be located at respective crossing-regions of the scan lines S1 through Sn and the data lines D1 through Dm. The pixel(s) 111 may store a data signal in response to a scan signal, and may emit light based on the stored data signal.

The scan driver 120 may generate the scan signal based on a scan driving control signal SCS. The scan driving control signal SCS may be provided from the timing controller 130. The scan driving control signal SCS may include a start pulse and clock signals, and the scan driver 120 may include a shift register that generates the scan signal corresponding to the start pulse and the clock signals.

The timing controller 130 may control the scan driver 120 and the data driver 140. The timing controller 130 may generate the scan driving control signal SCS and a data driving control signal DCS, and may control the scan driver 120 and the data driver 140 using generated signals.

In some embodiments, the timing controller 130 may calculate an on-pixel ratio (OPR) of the first input image data DATA1, which is provided from the external component. Here, the OPR may represent a ratio of a number of the pixels 111 that are turned-on according to the first input image data DATA1 to a total number of the pixels 111. For example, the timing controller 130 may calculate the OPR for every frame (or, for each of frames) when the first input image data DATA1 includes frames. That is, the timing controller 130 may calculate the OPR in units of frames.

In some embodiments, the timing controller 130 may generate second input image data DATA2 by processing the first input image data DATA1. For example, the timing controller 130 may generate the second input image data DATA2 (e.g., grayscale data that is compensated for degradation) by compensating the first input image data DATA1 (e.g., grayscale data corresponding to the pixel 111) based on a degradation of a pixel(s) 111.

The data driver 140 may generate the data signal based on the second input image data DATA2, and may provide the data signal to the display panel 110 (or, to the pixel(s) 111). The data driver 140 may provide the data signal to the display panel 110 in response to the data driving control signal DCS.

In some embodiments, the data driver 140 may include gamma correction values, may select a first gamma correction value among the gamma correction values based on the OPR of the first input image data DATA1, and may generate the data signal based on the second input image data DATA2 and the first gamma correction value. Here, the gamma correction values may correspond to OPRs that are different from each other. For example, the gamma correction values may include the first gamma correction value and a second gamma correction value.

The first gamma correction value may be based on a first test image (e.g., a predetermined first test image) that has a first OPR (e.g., an OPR of 1, or of 100%), and may include a correction value (or, a compensation value) to correct/compensate a difference between a target luminance (or, a target display luminance) of the display panel 110, which corresponds to a gamma curve (e.g., a predetermined gamma curve, or a reference gamma curve such as a gamma curve 2.2), and a real luminance (or, a real display luminance) of the display panel 110, which corresponds to the first test image (e.g., the second input image data DATA2). For example, the second gamma correction value may be based on a second test image that has a second on-pixel ratio (e.g., an OPR of 70%) and may include a correction value (or, a compensation value) to compensate/correct a difference between a target luminance of the display panel 110 (according to the predetermined gamma curve) and a real luminance of the display panel 110 (according to the second test image).

For example, the data driver 140 may generate a gamma voltage based on grayscale data (or, a grayscale value), which corresponds to the pixel(s) 111, the grayscale data being among the second input image data DATA2, and may compensate the gamma voltage based on the first gamma correction value. In this case, the pixel(s) 111 may emit light based on a compensated gamma voltage.

A configuration of the data driver 140 will be described in detail with reference to FIG. 2.

The display device 100 may further include a power supply. The power supply may generate a driving voltage to drive the display device 100. The driving voltage may include a first power voltage ELVDD and a second power voltage ELVSS. The first power voltage ELVDD may be greater (or, higher) than the second power voltage ELVSS.

As described above, the display device 100 according to embodiments may include the gamma correction values, which are determined for every OPR, may select the first gamma correction value based on the OPR of the first input image data DATA1, and may generate the data signal based on the first gamma correction value. Therefore, the display device 100 may reduce a luminance error (i.e., may reduce a luminance difference between the target luminance and the real luminance), which may occur during display of an image based on a gamma correction value that is determined regardless of the OPR. That is, the display device 100 may compensate a phenomenon in which a gamma curve is changed depending on a change of the first input image data DATA1 (e.g., a change of the OPR) using the first gamma correction value, which is determined (or, selected) for every OPR.

Figure 2A:
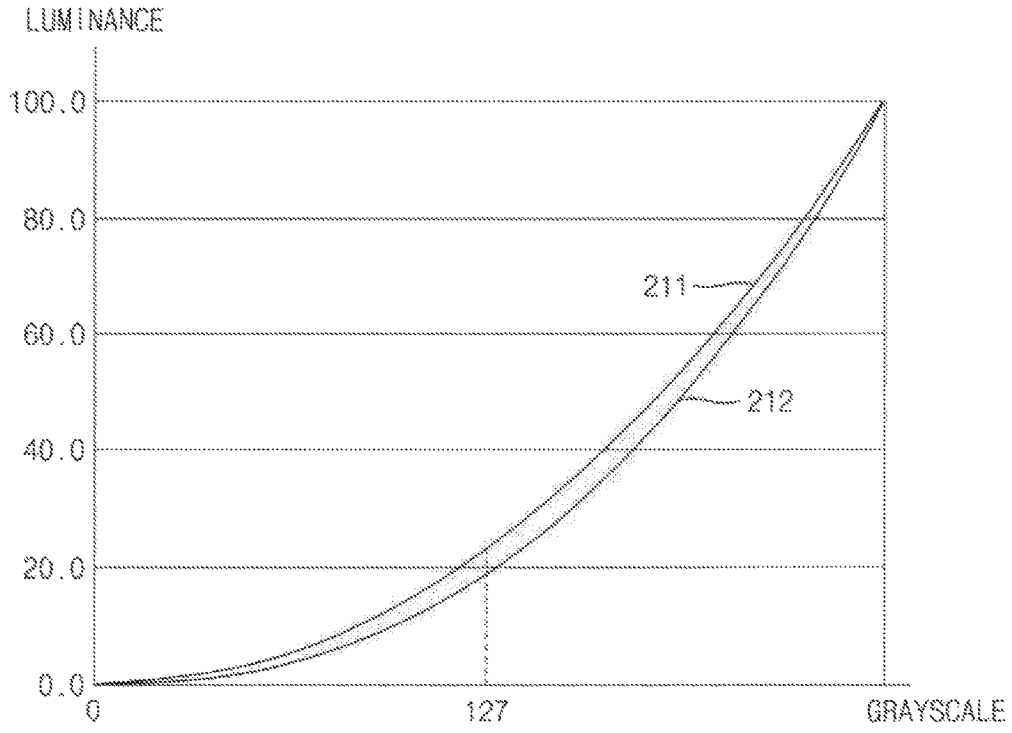
FIG. 2A is a diagram illustrating an example of a gamma curve used by the display device of FIG. 1.
Figure 2B:
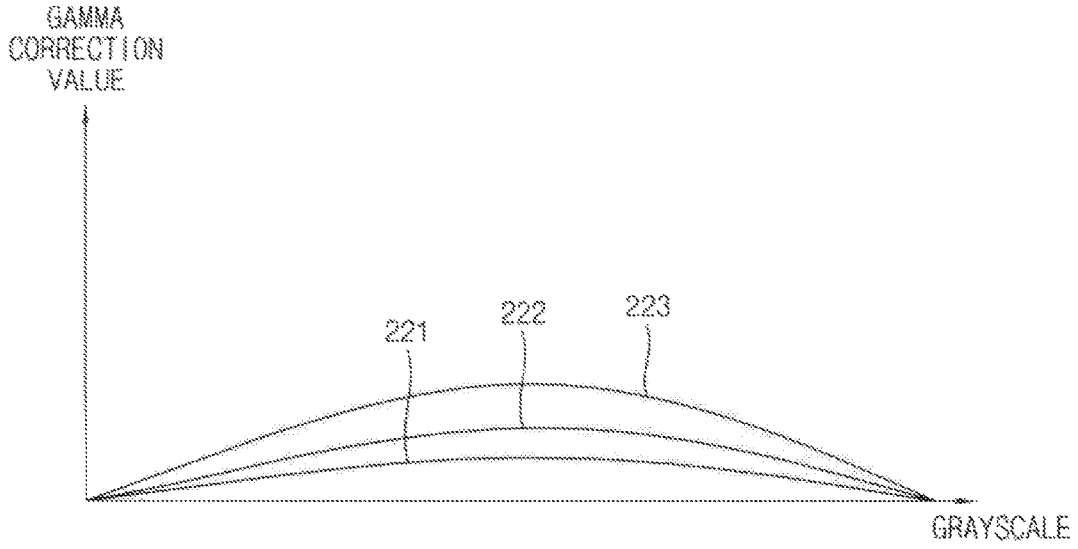
FIG. 2B is a diagram of an example of gamma correction values used by the display device of FIG. 1.

FIG. 2A is a diagram illustrating an example of a gamma curve used by the display device of FIG. 1. FIG. 2B is a diagram of an example of gamma correction values used by the display device of FIG. 1.

Referring to FIGS. 2A and 2B, a first gamma curve 211 may define (or, represent) a correlation between a luminance (or, a target luminance) and grayscale data (or, a grayscale value). For example, the first gamma curve 211 may be a gamma curve 2.2.

A second gamma curve 212 may represent a correlation between a measured luminance of the display device 100 and the grayscale data. As illustrated in FIG. 2A, the second gamma curve 212 may have a luminance difference with respect to the first gamma curve 211 (e.g., may be offset from the first gamma curve 211). For example, the second gamma curve 212 may be a gamma curve 2.4.

Referring to FIG. 2B, a first gamma correction curve 221 may include the first gamma correction value, which is determined (or, set) to compensate a variation (or, the luminance difference) between the measured luminance (or, a real luminance) and the target luminance. The first gamma correction curve 221 may be set (or, determined) based on a first test image that has an OPR of 100% (e.g., an image that has a full white pattern), and may be set (or, determined) during a test process (or, a test process in which a gamma setting is performed) of the display panel 110 (or, the display device 100). For example, the first gamma correction value may have the largest value in a middle grayscale region (e.g., at a grayscale value of 127) and may have lower values in a low grayscale region (e.g., grayscale values ranging from 0 through 127) and in a high grayscale region (e.g., grayscale values ranging from 127 through 255).

When the display device 100 displays the first test image that has an OPR of 100% based on the first gamma correction curve 221 (or, the first gamma correction value), the real luminance of the display device 100 may be represented on or along the first gamma curve 211. That is, the display device 100 may correctly display an image that has an OPR of 100% (e.g., the first test image) with a target luminance using the first gamma correction curve 221.

However, a measured luminance (or, a real luminance) of the display device 100 may be represented on the second gamma curve 212 instead of the first gamma curve 211 when the display device 100 displays a second test image that has an OPR of, for example, 50% based on the first gamma correction curve 221.

A second gamma correction curve 222 may include a second gamma correction value that is determined (or, set) based on the second test image, which has an OPR of 50%. The second gamma correction curve 222 may have a shape that is similar to a shape of the first gamma correction curve 221, but the second gamma correction value is different from the first gamma correction value.

The display device 100 may display the second test image, which has the OPR of 50%, using the second gamma correction curve 222 (or, the second gamma correction value). In this case, the measured luminance (or, the real luminance) of the display device 100 may be represented on the first gamma curve 211. That is, the display device 100 may correctly display an image (e.g., the second test image), which has an OPR of 50%, with a target luminance using the second gamma correction curve 222.

A third gamma correction curve 223 may include a third gamma correction value that is determined (or, set) based on a third test image that has an OPR of, for example, 10%. The third gamma correction curve 223 may have a shape that is similar to a shape of the first gamma correction curve 221, but the third gamma correction value is different from the first gamma correction value.

As described above, the display device 100 may include gamma correction values that are determined (or, set) based on respective test images (e.g., the first test image, the second test image, and the third test image), which have different OPRs from each other, and may display an image using a certain gamma correction value that corresponds to a certain OPR of the image. Therefore, the display device 100 may correctly display the image with a target luminance of the image.

The gamma correction curves 221, 222, and 223 (or, the gamma correction values) illustrated in FIG. 2B are exemplary. However, the gamma correction curves 221, 222, and 223 are not limited thereto. For example, the gamma correction curves 221, 222, and 223 may have gamma correction values that are constant regardless of a change of grayscale vales, and a number of gamma correction curves may be greater than 3.

Figure 3:
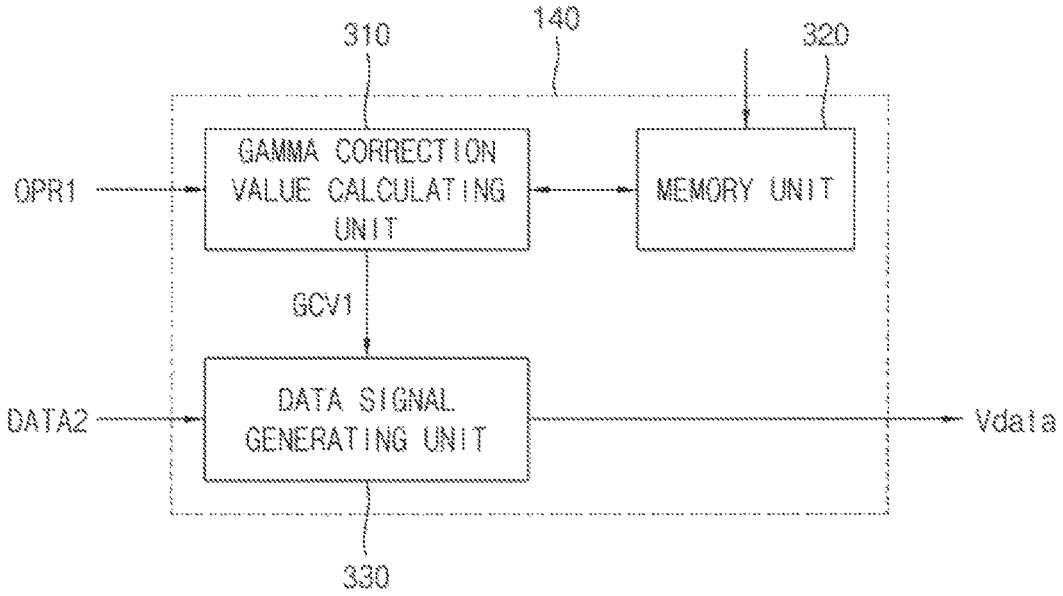
FIG. 3 is a block diagram illustrating an example of a data driver included in the display device of FIG. 1.

FIG. 3 is a block diagram illustrating an example of a data driver included in the display device of FIG. 1.

Referring to FIG. 3, the data driver 140 may include a gamma correction value calculator (e.g., a gamma correction value calculating unit) 310, a memory (e.g., a memory unit or a storage unit) 320, and a data signal generator (e.g., a data signal generating unit) 330.

The gamma correction value calculator 310 may calculate a first gamma correction value GCV1 based on a first on-pixel ratio OPR1 (i.e., an OPR of second input image data DATA2 generated by the timing controller 130).

In some embodiments, the gamma correction value calculator 310 may select the first gamma correction value GCV1 from among gamma correction values based on the first on-pixel ratio OPR1. Here, the gamma correction values may be predetermined, and may be stored in the memory 320. That is, the gamma correction value calculator 310 may search for the first gamma correction value GCV1 corresponding to the first on-pixel ratio OPR1 among the gamma correction values.

In some embodiments, the gamma correction values may include OPRs that are different from each other, and the gamma correction value calculator 310 may determine whether the OPRs, which are respectively included in the gamma correction values, match the first on-pixel ratio OPR1. The gamma correction value calculator 310 may select the first gamma correction value GCV1 that has an OPR that is equal to the first on-pixel ratio OPR1. For example, when the first on-pixel ratio OPR1 is 70%, the gamma correction value calculator 310 may select the first gamma correction value GCV1 that has an OPR of 70% from among the gamma correction values.

In some embodiments, when the gamma correction value calculator 310 does not find a first gamma correction value GCV1 that has an OPR that is equal to the first on-pixel ratio OPR1, the gamma correction value calculator 310 may select a second gamma correction value from among the gamma correction values. Here, the second gamma correction value may correspond to a second OPR, which may be the closest (or, the most similar) to the first on-pixel ratio OPR1. For example, when the memory 320 includes some gamma correction values that correspond to some OPRs (e.g., 100%, 50%, 10%), and which may correspond to capacity of the memory 320, the gamma correction value calculator 310 may select a second gamma correction value that has a second OPR of 50%, which is adjacent a first OPR of 70%. Here, the gamma correction value calculator 310 may provide the data signal generator 330 with the second gamma correction value as the first gamma correction value GCV1.

In some embodiments, when the gamma correction value calculator 310 does not search the first gamma correction value GCV1, which has an OPR that is equal to the first on-pixel ratio OPR1, the gamma correction value calculator 310 may select both the second gamma correction value corresponding to the second OPR and a third gamma correction value corresponding to a third on-pixel ratio from among the gamma correction values. Here, the second OPR and the third OPR may be adjacent the first on-pixel ratio OPR1. After this, the gamma correction value calculator 310 may calculate the first gamma correction value GCV1 based on the second gamma correction vale and the third gamma correction value. For example, when the memory 320 includes some gamma correction values that correspond to some OPRs (e.g., 100%, 50%, 10%), which may be determined according to capacity of the memory 320, and when the first on-pixel ratio OPR1 is 70%, the gamma correction value calculator 310 may select a second gamma correction value, which has a second OPR of 50%, and a third gamma correction value, which has a third OPR of 100%.

The gamma correction value calculator 310 may calculate the first gamma correction value GCV1 by interpolating (or, by extrapolating) the second gamma correction value and the third gamma correction value. For example, the gamma correction value calculator 310 may calculate the first gamma correction value GCV1 based on an equation such as, for example, "a first gamma correction value GCV1=(a third gamma correction value−a second gamma correction value)/(a third OPR−a second OPR)*(a first on-pixel ratio OPR1−a second OPR)."

In some embodiments, the gamma correction value calculator 310 may calculate a gamma correction value for every sub pixel. For example, the pixel 111 may include a first sub pixel that emits light with a first color, a second sub pixel that emits light with a second color, and a third sub pixel that emits light with a third color. Here, the timing controller 130 may calculate a first sub on-pixel ratio (sub OPR) for the first sub pixel, a second sub OPR for the second sub pixel, and a third sub OPR for the third sub pixel. In this case, the gamma correction value calculator 310 may select a first sub gamma correction value from among the gamma correction values based on the first sub OPR, may select a second sub gamma correction value among the gamma correction values based on the second sub OPR, and/or may select a third sub gamma correction value among the gamma correction values based on the third sub OPR.

The memory 320 may store the gamma correction values. For example, the memory 320 may be a non-volatile memory (NVM), such as an electrically erasable programmable read-only memory (EEPROM).

The data signal generator 330 may generate a data signal Vdata based on the second input image data DATA2 (e.g., based on image data provided from the timing controller 130) and the first gamma correction value GCV1. For example, the data signal generator 330 may generate a data voltage (or, a gamma voltage) corresponding to grayscale data (or, a grayscale value) using reference gamma voltages. Here, the reference gamma voltages may be voltages that are provided to the data driver 140 to generate a data voltage (or, a driving current) based on the grayscale data.

For reference, the reference gamma voltages are determined according to the gamma curve, but a real gamma curve (or, a gamma characteristic) of the display panel 110 may be changed according to the first input image data DATA1. The data signal generator 330 may compensate a change of the gamma curve by controlling (or, by adjusting) the reference gamma voltage based on the first gamma correction value GCV1. Therefore, the display device 100 may display an image with a luminance that is equal to a target luminance of the image even through the first input image data DATA1 is changed (or, even though an OPR of the first input image data DATA1 is changed).

As described above, the data driver 140 may calculate the first gamma correction value GCV1 based on the first on-pixel ratio OPR1 of the first input image data DATA1, and may generate the data signal Vdata based on the first gamma correction value GCV1, where the first on-pixel ratio OPR1 is calculated by the timing controller 130. The data driver 140 may reduce a luminance error (e.g., may reduce a luminance difference between a target luminance and a real luminance) by compensating the reference gamma voltages corresponding to a change of the first input image data DATA1 based on the first gamma correction value GCV1.

Figure 4:
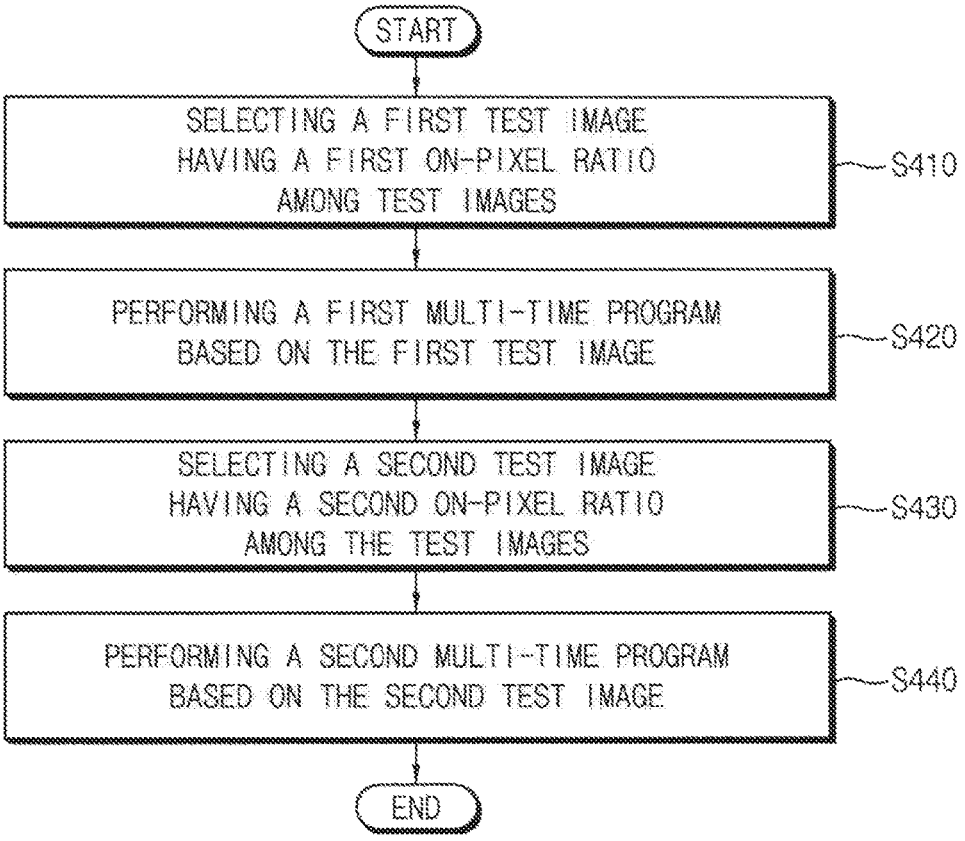
FIG. 4 is a flow diagram illustrating a method of testing a display device according to embodiments.
Figure 5:
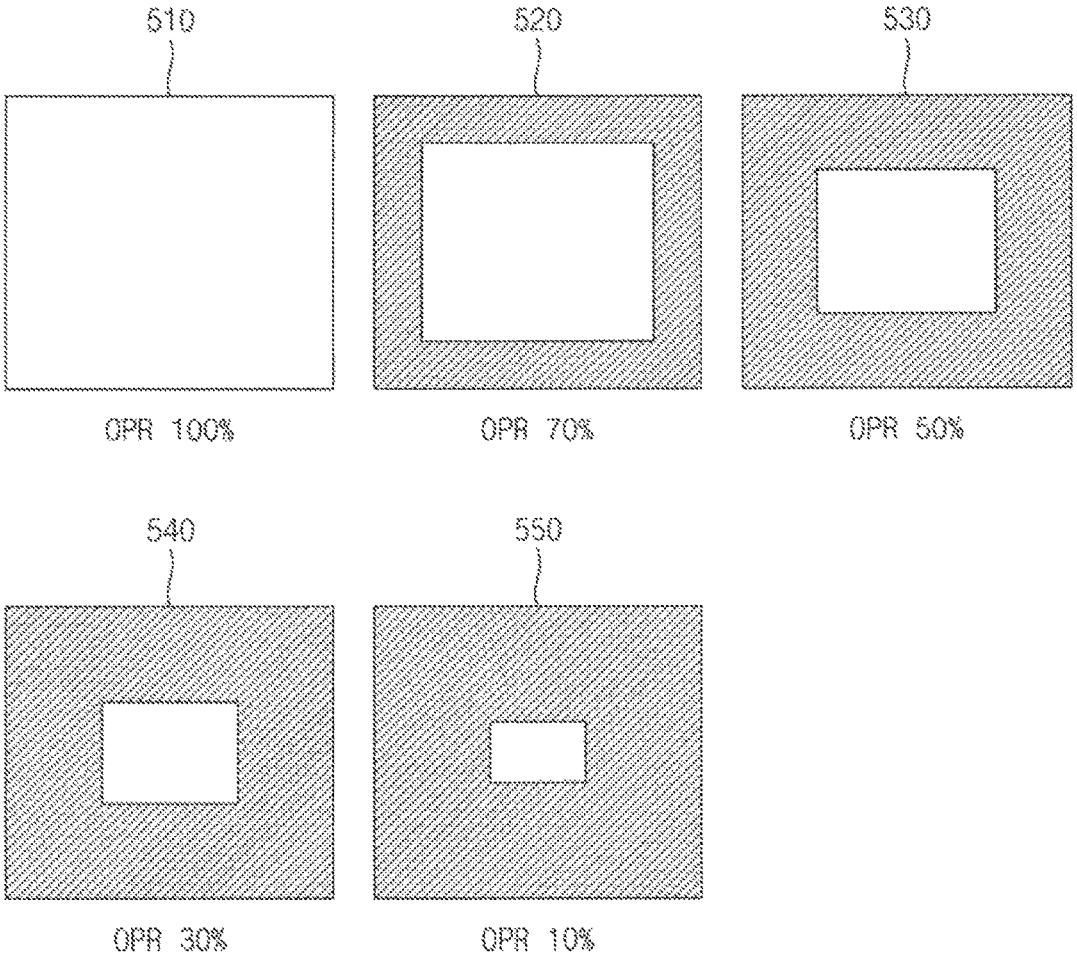
FIG. 5 is a diagram illustrating examples of a test image used by the method of FIG. 4.

FIG. 4 is a flow diagram illustrating a method of testing a display device according to embodiments. FIG. 5 is a diagram illustrating examples of a test image used by the method of FIG. 4.

Referring to FIGS. 1, 4, and 5, the method of FIG. 4 may perform a gamma setting for the display device of FIG. 1. Through the gamma setting, the method of FIG. 4 may determine (or, set) a correlation between a display luminance of the display device 100 and grayscale data (or, a grayscale value), and the gamma setting may be defined according to a gamma curve.

The method of FIG. 4 may select a first test image, which has a first OPR, from among test images (S410). Here, the test images may respectively have different on-pixel ratios, and each of the different on-pixel ratios may respectively represent a ratio of a number of pixels that are turned on to a total number of pixels included in the display panel 110 according to each of the test images.

As illustrated in FIG. 5, the test images 510, 520, 530, 540, and 550 may have OPRs of 100%, 70%, 50%, 30% and 10%, respectively. Each of the test images may include a black pattern and/or a white pattern (e.g., a white pattern surrounded by a black pattern). Here, pixels corresponding to the black pattern may be turned off, and pixels corresponding to the white pattern may be turned on. Therefore, an eleventh test image 510 may have an OPR of 100%, a twelfth test image 520 may have an OPR of 70%, a thirteenth test image 530 may have an OPR of 50%, a fourteenth test image 540 may have an OPR of 30%, and a fifteenth test image 550 may have an OPR of 10%. The test images 510, 520, 530, 540, and 550 are illustrated by way of an example in FIG. 5, although the test images 510, 520, 530, 540, and 550 are not limited thereto. For example, the twelfth test image 520 may include an image of an object instead of a black/white pattern, and may have an OPR of, for example, 80% instead of 70%.

For example, the method of FIG. 4 may select the eleventh test image 510, which has an OPR of 100%, from among the test images as the first test image.

The method of FIG. 4 may perform a first multi-time program for the display panel 110 based on the first test image (S420). Here, the first multi-time program may be a multi-time program that is performed by the method of FIG. 4 at a first time. The method of FIG. 4 may determine a first gamma correction value to compensate a difference between a target luminance of the display panel 100, which corresponds to a predetermined gamma curve (e.g., a gamma curve 2.2), and a real luminance of the display panel 110, which corresponds to the first test image. The first multi-time program (or, a multi-time program) may be performed by repeated attempts (e.g., trial and error) to repeat calibration and measurement until a measurement result is within an acceptable range. The multi-time program will be described in detail with reference to FIGS. 6A and 6B.

In some embodiments, the method of FIG. 4 may perform the multi-time program for every sub pixel. For example, when the display panel 110 includes first through third sub pixels, the method of FIG. 4 may perform first through third sub multi-time programs for each of the first through third sub pixels.

Therefore, the method of FIG. 4 may generate (or, determine) the first gamma correction value, which has the first OPR (e.g., an OPR of 100%), through the first multi-time program. The first gamma correction value may be stored into a memory device included in the display device 100.

After this, the method of FIG. 4 may generate a second gamma correction value that has a second OPR.

In some embodiments, the method of FIG. 4 may select a second test image, which has the second OPR, from among the test images (S430), and may perform a second multi-time program for the display panel 110 based on the second test image. For example, the method of FIG. 4 may select the thirteenth test image 530, which has an OPR of (for example) 50%, as the second test image from among the test images 510, 520, 530, 540, and 550, and may perform the second multi-time program for the display panel 110 based on the thirteenth test image 530.

Therefore, the method of FIG. 4 may generate (or, determine) a second gamma correction value, which has the second OPR (e.g., an OPR of 70%), through the second multi-time program. The second gamma correction value may be stored into the memory device included in the display device 100.

The second OPR may be determined based on an acceptable tolerance of a predetermined gamma curve of the display panel 110. That is, a number of the multi-time programs may be determined based on the acceptable tolerances. For example, when the acceptable tolerance is 4%, a number of the multi-time programs may be 2 (or, two times), and the second OPR may be 70%. As the acceptable tolerance becomes larger, a difference between the second OPR and the first OPR may be larger, and the method of FIG. 4 may perform the multi-time programs with a fewer number of times.

In some embodiments, the method of FIG. 4 may determine (or, calculate) the second gamma correction value corresponding to the second OPR based on the first gamma correction value. For example, the method of FIG. 4 may calculate the second gamma correction value using a linear equation (or, a look-up table, etc.) that represents a correlation between the first gamma correction value and the second gamma correction value. Here, the linear equation may be predetermined through repeated experiments, for example.

In this case, the method of FIG. 4 may perform no multi-time program (or, might not perform the second multi-time program) for determining the second gamma correction value. Therefore, a test time (e.g., a time for gamma setting) may be reduced. For example, the method of FIG. 4 may determine the first gamma correction value corresponding to an OPR of 100% through the first multi-time program, and may calculate both the second gamma correction value corresponding to an OPR of 70% and a third gamma correction value corresponding to an OPR of 50% based on the first gamma correction value. For example, the method of FIG. 4 may determine the first gamma correction value corresponding to an OPR of 100% through the first multi-time program, may determine the second gamma correction value corresponding to an OPR of 70% based on the first gamma correction value, and may calculate the third gamma correction value corresponding to an OPR of 50% based on the first gamma correction value.

As described above, the method of FIG. 4 may repeatedly perform the multi-time programs based on the test images that have different OPRs. Therefore, the method of FIG. 4 may generate (or, determine) gamma correction values corresponding to the different OPRs. In addition, the method of FIG. 4 may reduce the test time (or, the time for gamma setting) by calculating some gamma correction values based on a certain gamma correction value.

Figure 6A:
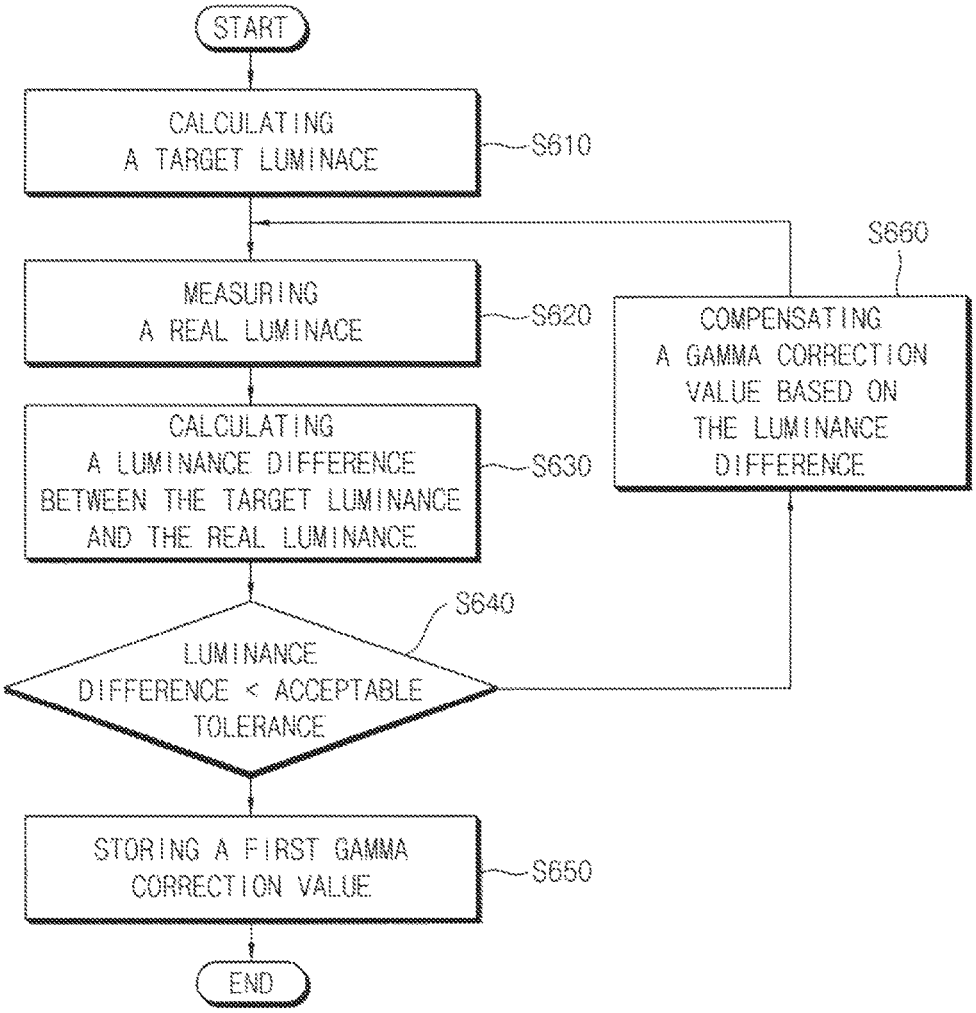
FIG. 6A is a flow diagram illustrating an example of a first multi-time program included in the method of FIG. 4.
Figure 6B:
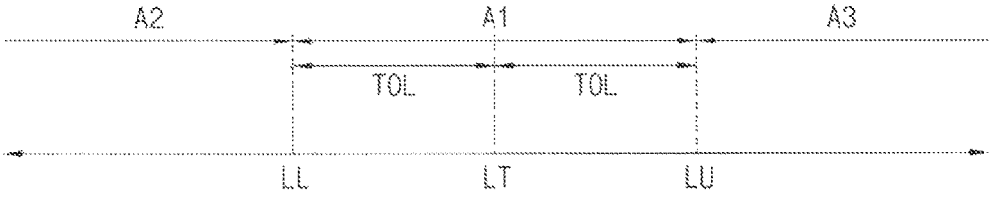
FIG. 6B is a diagram for describing a first multi-time program included in the method of FIG. 4.

FIG. 6A is a flow diagram illustrating an example of a first multi-time program included in the method of FIG. 4. FIG. 6B is a diagram for describing a first multi-time program included in the method of FIG. 4.

Referring to FIGS. 6A and 6B, the method of 6A may calculate a target luminance using a gamma curve (e.g., a predetermined gamma curve, such as a gamma curve 2.2.) (S610). That is, the method of FIG. 6A may calculate the target luminance corresponding to grayscale data (or, a grayscale value) included in a test image using the predetermined gamma curve.

The method of FIG. 6A may measure a real luminance according to a first test image based on a first gamma correction value, which may be predetermined (or, pre-set) (S620). Here, the first gamma correction value may have no information. For example, an initial value of the first gamma correction value may be 0. The method of FIG. 6A may provide the test image to the display panel 110, and the display panel 110 may display the test image based on the gamma curve (e.g., predetermined gamma curve 2.2) and based on the first gamma correction value (e.g., a value of 0). Here, the method of FIG. 6A may measure the real luminance of the display panel 110 using a luminance measuring device.

The method of FIG. 6A may calculate a luminance difference between the target luminance and the real luminance (S630). For example, as described with reference to FIG. 2A, the target luminance corresponding to a grayscale value of 127 may be represented on the first gamma curve 211, and the real luminance corresponding to the grayscale value of 127 may be represented on the second gamma correction curve 222. The method of FIG. 6A may calculate the luminance difference corresponding to the grayscale value of 127.

The method of FIG. 6A may determine whether the luminance difference is within an acceptable tolerance (e.g., below a level associated with an acceptable tolerance) (S640). Here, the acceptable tolerance may represent a range of gamma settings (or, a gamma curve) of the display panel 110 (or, the display device 100). Referring to FIG. 6B, a first luminance region (or, a first luminance range) A1 may correspond to the acceptable tolerance. The first luminance region A1 may include a lower threshold LL and an upper threshold LU with respect to a target luminance LT. Here, the upper threshold LU may be greater than the target luminance LT by the acceptable tolerance TOL, and the lower threshold LL may be lower than the target luminance LT by the acceptable tolerance TOL. That is, the method of FIG. 6A may determine whether the target luminance is within the first luminance region A1.

In some embodiments, when the luminance difference is within the acceptable tolerance, the method of FIG. 6A may store the first gamma correction value into the memory device (S650). That is, when the real luminance is within the first luminance region A1, the method of FIG. 6A may determine that the display panel 110 operates normally according to the predetermined gamma curve, and may store the first gamma correction value into the memory device.

In some embodiments, when the luminance difference is beyond/outside of/exceeds the acceptable tolerance, the method of FIG. 6A may compensate the first gamma correction value based on the luminance difference (S660). For example, when the real luminance is within (or, in) a second luminance region A2 instead of the first luminance region A1 (see FIG. 6B), the method of FIG. 6A may increase the first gamma correction value to increase the real luminance. Additionally, and for example, when the real luminance is within (or, in) a third luminance region A3 instead of the first luminance region A1 (see FIG. 6B), the method of FIG. 6A may decrease the first gamma correction value to decrease the real luminance.

After this, the method of FIG. 6A may perform the steps S620 through S640 (e.g., may again perform the steps S620, S630, and S640). That is, the method of FIG. 6A may re-measure the real luminance according to the first test image based on the first gamma correction value that is compensated (or, a first compensated gamma correction value), may re-calculate the luminance difference between the target luminance and the real luminance that is re-measured, and may determine whether the luminance difference, which is re-calculated, is within the acceptable tolerance.

The method of FIG. 6A may store the first gamma correction value that is compensated (or, the first compensated gamma correction value) when a re-calculated luminance difference is within the acceptable tolerance.

The method of FIG. 6A may be repeated, and may be performed for every grayscale value. For example, the method of FIG. 6A may be repeatedly performed for each of 256 grayscale values. As another example, the method of FIG. 6A may be repeatedly performed for eight different grayscale values that are selected among 256 different grayscale values.

As described above, the method of FIG. 6A may perform compensation of the first gamma correction value and measurement of luminance based on the first gamma correction value until the real luminance of the display panel 110 according to the first test image is within the acceptable tolerance, and may also store (or, determine) the first gamma correction value, which is compensated, as a gamma correction value for the first test image (or, a first OPR) when the real luminance is within the acceptable tolerance.

Figure 7:
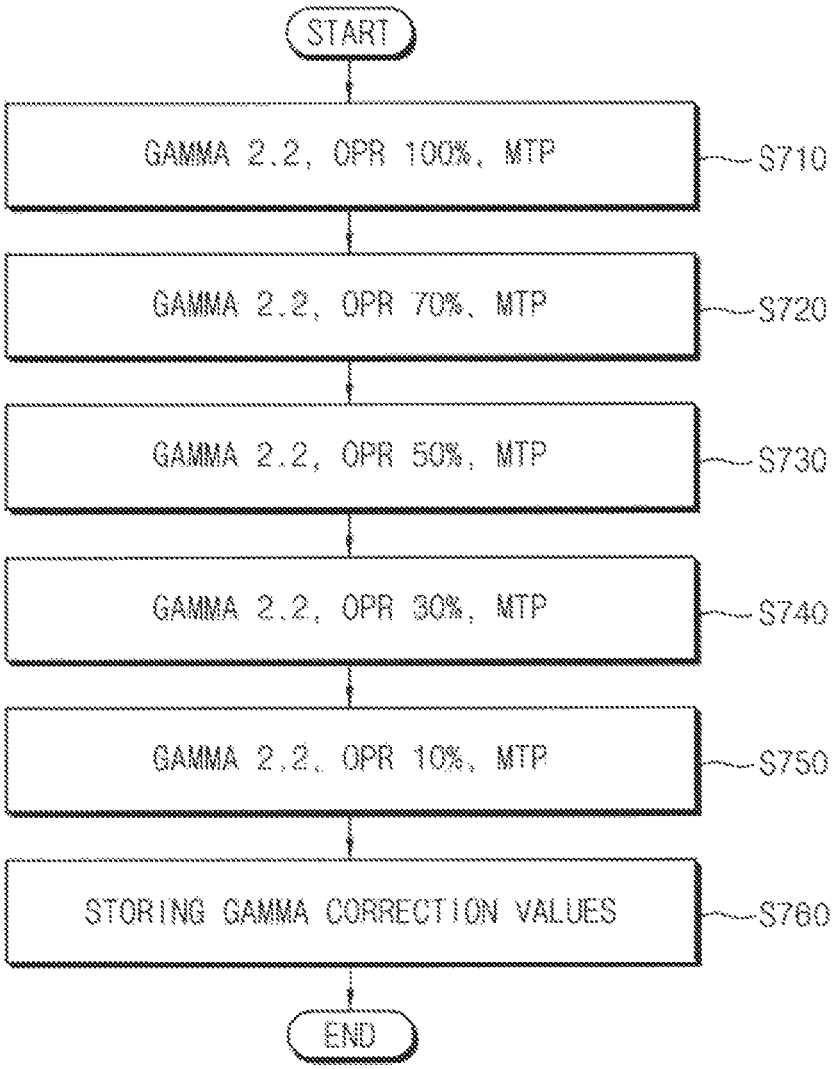
FIG. 7 is a flow diagram illustrating an example of the method of FIG. 4.

FIG. 7 is a flow diagram illustrating an example of the method of FIG. 4.

Referring to FIG. 7, the method of FIG. 7 may perform a multi-time program (MTP) based on a first test image, which has an OPR of 100%, such that a gamma characteristic of the display panel 110 satisfies a gamma curve 2.2 (S710). Here, the method of FIG. 7 may obtain a first gamma correction value corresponding to the OPR of 100%.

The method of FIG. 7 may perform a multi-time program (MTP) based on a second test image, which has an OPR of 70%, such that a gamma characteristic of the display panel 110 satisfies a gamma curve 2.2 (S720). Here, the method of FIG. 7 may obtain a second gamma correction value corresponding to the OPR of 70%.

Similarly, the method of FIG. 7 may sequentially perform multi-time programs based on a third test image, which has an OPR of 50%, a fourth test image, which has an OPR of 30%, and a fifth test image, which has an OPR of 10% (S730, S740, and S750). Here, the method of FIG. 7 may obtain third, fourth, and fifth gamma correction values corresponding to OPRs of 50%, 30%, and 10%, respectively.

The method of FIG. 7 may store the gamma correction values (e.g., the first through fifth gamma correction values) into the memory device (S760).

As described above, the method of testing a display device according to embodiments may repeatedly perform a multi-time program (MTP) based on the test images that respectively have OPRs that are different from each other. Therefore, the method may generate (or, determine) gamma correction values corresponding to OPRs that are different from each other.

The present inventive concept may be applied to any display device including a gamma voltage generator (e.g., an organic light emitting display device, a liquid crystal display device, etc.). For example, the present inventive concept may be applied to a television, a computer monitor, a laptop, a digital camera, a cellular phone, a smart phone, a personal digital assistant (PDA), a portable multimedia player (PMP), an MP3 player, a navigation system, a video phone, etc.

The foregoing is illustrative of embodiments, and is not to be construed as limiting thereof. Although a few embodiments have been described, those skilled in the art will readily appreciate that many modifications are possible in the embodiments without materially departing from the novel teachings and advantages of embodiments. Accordingly, all such modifications are intended to be included within the scope of embodiments as defined in the claims. In the claims, means-plus-function clauses are intended to cover the structures described herein as performing the recited function and not only structural equivalents but also equivalent structures. Therefore, it is to be understood that the foregoing is illustrative of embodiments and is not to be construed as limited to the specific embodiments disclosed, and that modifications to the disclosed embodiments, as well as other embodiments, are intended to be included within the scope of the appended claims. The inventive concept is defined by the following claims, with equivalents of the claims to be included therein.

What is claimed is:

1. A display device comprising:

a display panel comprising pixels;

a timing controller configured to calculate an on-pixel ratio of input image data provided from an external component, the on-pixel ratio representing a ratio of a number of the pixels that are turned-on according to the input image data to a total number of the pixels; and a data driver configured to select a first gamma correction value from among a plurality of gamma correction values based on the on-pixel ratio, and configured to generate a data signal based on the input image data and the first gamma correction value.

2. The display device of claim 1, wherein the input image data comprises frames, and wherein the timing controller is configured to calculate the on-pixel ratio for each of the frames.

3. The display device of claim 2, wherein the gamma correction values respectively correspond to different on-pixel ratios.

4. The display device of claim 3, wherein the first gamma correction value is based on a test image that has the on-pixel ratio, and wherein the first gamma correction value comprises a correction value to compensate a difference between a target luminance of the display panel that corresponds to a gamma curve and a real luminance of the display panel that corresponds to the input image data.

5. The display device of claim 3, wherein the data driver is configured to select a second gamma correction value, which corresponds to a second on-pixel ratio that is adjacent the on-pixel ratio, from among the gamma correction values, and wherein the data driver is configured to determine the first gamma correction value with the second gamma correction value.

6. The display device of claim 3, wherein the data driver is configured to select a second gamma correction value, which corresponds to a second on-pixel ratio, from among the gamma correction values, and is configured to select a third gamma correction value, which corresponds to a third on-pixel ratio, from among the gamma correction values, wherein the data driver is configured to calculate the first gamma correction value based on the second gamma correction value and the third gamma correction value, and wherein the second gamma correction value and the third gamma correction value correspond to on-pixel ratios that are closest to the on-pixel ratio.

7. The display device of claim 6, wherein the data driver is configured to calculate the first gamma correction value by interpolating the second gamma correction value and the third gamma correction value.

8. The display device of claim 1, wherein each of the pixels comprises a first sub pixel, a second sub pixel, and a third sub pixel, and wherein the timing controller is configured to calculate a first sub on-pixel ratio for the first sub pixel, a second sub on-pixel ratio for the second sub pixel, and a third sub on-pixel ratio for the third sub pixel, respectively.

9. The display device of claim 8, wherein the timing controller is configured to select a first sub gamma correction value from among the gamma correction values based on the first sub on-pixel ratio, is configured to select a second sub gamma correction value from among the gamma correction values based on the second sub on-pixel ratio, and is configured to select a third sub gamma correction value from among the gamma correction values based on the third sub on-pixel ratio.

* * * * *